US009221586B2

(12) United States Patent
Szczesniak et al.

(10) Patent No.: US 9,221,586 B2
(45) Date of Patent: Dec. 29, 2015

(54) METAL CLOSURE AND SEAL COMBINATION FOR MAINTAINING THE SHAPE OF A PLASTIC CONTAINER NECK

(71) Applicant: Silgan White Cap LLC, Downers Grove, IL (US)

(72) Inventors: Dennis Szczesniak, Lemont, IL (US); William J. Kapolas, Palatine, IL (US); James M. Taber, Aurora, IL (US); Stephen J. Kras, Chicago, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 14/522,159

(22) Filed: Oct. 23, 2014

(65) Prior Publication Data

US 2015/0041474 A1 Feb. 12, 2015

Related U.S. Application Data

(63) Continuation of application No. 13/835,287, filed on Mar. 15, 2013, now Pat. No. 8,893,906.

(51) Int. Cl.
*B65D 41/04* (2006.01)
*B65D 79/00* (2006.01)
(Continued)

(52) U.S. Cl.
CPC ..... *B65D 41/0442* (2013.01); *B65D 41/0457* (2013.01); *B65D 41/065* (2013.01); *B65D 41/385* (2013.01); *B65D 79/005* (2013.01)

(58) Field of Classification Search
CPC .... B65D 41/125; B65D 41/12; B65D 41/065; B65D 41/06; B65D 41/04; B65D 41/0435; B65D 41/385; B65D 79/005; B65D 41/38; B65D 41/34; B21D 51/46; B21D 51/44
USPC ..... 215/327, 324, 316, 332, 329, 44, 43; 220/324, 315, 310.1, 309.1, 304, 295, 220/293; 413/9, 8
See application file for complete search history.

(56) References Cited

U.S. PATENT DOCUMENTS 2,708,050 A * 5/1955 Luertzing et al. ..... 215/324
3,012,687 A 12/1961 Dallay
(Continued)

FOREIGN PATENT DOCUMENTS

JP 2002-059932 2/2002

OTHER PUBLICATIONS

International Search Report and Written Opinion for International Application No. PCT/US2014/024797, mailing date Jun. 24, 2014, 15 pages.

*Primary Examiner* — Robert J Hicks
(74) *Attorney, Agent, or Firm* — Reinhart Boerner Van Deuren s.c.

(57) ABSTRACT

A closure that includes a top panel and a skirt extending downwardly from a peripheral edge of the top panel is provided. The skirt terminates in a plurality of spaced thread engagement flanges for engaging the thread of the neck of a container. The closure includes a polymer-filled channel which connects the top panel to the skirt. When engaged with the threaded neck of a container, the neck is forced into the channel and engaged by the polymer so that the channel and polymer provide lateral rigidity to the neck. This rigidity prevents the neck from deflecting from the forces resulting between the threads and thread engagement lugs when the forces therebetween are increased to the level required to adequately seal the closure to the container.

24 Claims, 3 Drawing Sheets

(51) Int. Cl.
*B65D 41/38* (2006.01)
*B65D 41/06* (2006.01)

(56) References Cited

U.S. PATENT DOCUMENTS

| | | | | | |
|---|---|---|---|---|---|
| 3,253,727 | A | * | 5/1966 | Hart | 215/345 |
| 3,286,867 | A | | 11/1966 | Mumford | |
| 3,411,651 | A | * | 11/1968 | Mumford | 215/333 |
| 3,963,142 | A | | 6/1976 | Hart | |
| 4,705,183 | A | | 11/1987 | Moloney | |
| 4,981,230 | A | | 1/1991 | Marshall et al. | |
| 4,989,740 | A | | 2/1991 | Vercillo | |
| 5,027,964 | A | | 7/1991 | Banich | |
| 5,035,341 | A | | 7/1991 | Hellman et al. | |
| 5,119,962 | A | | 6/1992 | Vercillo et al. | |
| 5,152,412 | A | | 10/1992 | Iler | |
| 5,190,175 | A | | 3/1993 | Schmidt | |
| 5,413,234 | A | | 5/1995 | Hekal et al. | |
| 5,426,912 | A | | 6/1995 | Hall et al. | |
| 5,581,978 | A | | 12/1996 | Hekal et al. | |
| 5,685,443 | A | | 11/1997 | Taber et al. | |
| 5,686,040 | A | | 11/1997 | Taber | |
| 5,833,087 | A | | 11/1998 | Pfeiffer | |
| 5,967,363 | A | | 10/1999 | Allen | |
| 6,056,136 | A | | 5/2000 | Taber et al. | |
| 6,375,023 | B1 | | 4/2002 | Lecinski et al. | |
| 6,677,397 | B1 | | 1/2004 | Baranowski et al. | |
| 6,823,651 | B2 | | 11/2004 | Thierjung et al. | |
| 6,964,346 | B1 | | 11/2005 | Taber et al. | |
| 7,367,465 | B2 | | 5/2008 | Taber et al. | |
| 7,942,281 | B2 | | 5/2011 | Bloom et al. | |
| 8,596,477 | B2 | | 12/2013 | Kras et al. | |
| 2010/0326994 | A1 | * | 12/2010 | Ichikawa et al. | 220/675 |
| 2013/0105499 | A1 | * | 5/2013 | Dunn et al. | 220/620 |
| 2013/0205718 | A1 | | 8/2013 | Kapolas | |
| 2014/0263155 | A1 | | 9/2014 | Szczesniak et al. | |

* cited by examiner

METAL CLOSURE AND SEAL COMBINATION FOR MAINTAINING THE SHAPE OF A PLASTIC CONTAINER NECK

CROSS-REFERENCE TO RELATED PATENT APPLICATION

This application is a continuation of U.S. application Ser. No. 13/835,287, filed Mar. 15, 2013, which is incorporated herein by reference in its entirety.

FIELD OF THE INVENTION

The present invention relates generally to the field of metal closures for containers. The present invention relates specifically to a metal closure and seal combination which interacts with the neck of a plastic bottle to maintain the shape of the neck while the closure is sealed to the neck.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Closures are utilized to seal or close containers for a wide variety of items including food, drink, medicine, cleaning products, etc. For many applications, integrity of the closure and integrity of the seal between the closure and the container, and the shape of the container neck must be maintained from the time when the container is filled and sealed until the closure is removed from the container by the end user. A closure and container combination may be subject to a variety of impact events (e.g., dropping, impact with processing machinery, impact with adjacent containers and/or shipping materials, etc.) that may inadvertently breach the integrity of the seal between the closure and the seal which may result in contamination, spoilage or spillage of the contents of the container.

SUMMARY OF THE INVENTION

One embodiment of the invention relates to a metal closure comprising. The metal closure includes a circular, closure panel having an internal surface extending to a periphery; a concentric channel extending from the periphery along an angled wall into a parallel wall generally parallel to the closure panel, the parallel wall extending into a first rounded wall having a center of radius within the closure, wherein the parallel wall is offset from the closure panel by a first distance; a concentric flange extending from the first rounded wall into a second rounded wall having a center of radius external to the closure into a transition wall which extends into third rounded wall having a center of radius within the closure, wherein the first rounded wall transitions into the second rounded wall at a second distance from the periphery, the second distance being at least 2 times as large as the first distance; a cylindrical skirt extending from the concentric flange; at least 4 equally spaced rolled flanges extending from the cylindrical skirt; at least one thread engagement flange located between each pair of rolled flanges; and a resilient polymeric material which fills the concentric channel.

Another embodiment of the invention relates to a metal closure. The metal closure includes a circular, closure panel having an internal surface extending to a periphery, wherein a vacuum indicating panel is located at the center of the internal surface; a concentric channel extending from the periphery along an angled wall into a parallel wall generally parallel to the closure panel, the parallel wall extending into a first rounded wall having a center of radius within the closure, wherein the parallel wall is offset from the closure panel by a first distance; a concentric flange extending from the first rounded wall into a second rounded wall having a center of radius external to the closure into a transition wall which extends into third rounded wall having a center of radius within the closure, wherein the first rounded wall transitions into the second rounded wall at a second distance from the periphery, the second distance being at least 2 times as large as the first distance, the radii of the first and second rolled walls are smaller than the radius of the third rolled wall, the angle between the angled wall and the parallel wall is between 20 and 75 degrees, the transition wall is generally parallel to the closure panel and the parallel wall, and a plane passing through the transition wall is displaced further from the parallel wall than the closure panel; a cylindrical skirt extending from the concentric flange; at least 4 equally spaced rolled flanges extending from the cylindrical skirt; at least one thread engagement flange located between each pair of rolled flanges wherein the engagement flanges include a tapered, rolled tip which facilitates sliding of the engagement flanges relative to a thread on a respective container neck; and a resilient polymeric material which fills the concentric channel.

Another embodiment of the invention relates to a sealed container. The sealed container includes a plastic container including a threaded neck which provides an opening to the container, the neck including generally parallel internal and external walls terminating at a sealing edge and a metal closure. The metal closure includes a circular, closure panel having an internal surface extending to a periphery, wherein a vacuum indicating panel is located at the center of the internal surface, a concentric channel extending from the periphery along an angled wall into a parallel wall generally parallel to the closure panel, the parallel wall extending into a first rounded wall having a center of radius within the closure, wherein the parallel wall is offset from the closure panel by a first distance, a concentric flange extending from the first rounded wall into a second rounded wall having a center of radius external to the closure into a transition wall which extends into third rounded wall having a center of radius within the closure, wherein the first rounded wall transitions into the second rounded wall at a second distance from the periphery, the second distance being at least 2 times as large as the first distance, the radii of the first and second rolled walls are smaller than the radius of the third rolled wall, the transition wall is generally parallel to the closure panel and the parallel wall, and a plane passing through the transition wall is displaced further from the parallel wall than the closure panel, a cylindrical skirt extending from the concentric flange, at least 4 equally spaced rolled flanges extending from the cylindrical skirt, at least one thread engagement flange located between each pair of rolled flanges wherein the engagement flanges include a tapered, rolled tip which facilitates sliding of the engagement flanges relative to a thread on a respective container neck, and a resilient polymeric material which fills the concentric channel; wherein the tapered, rolled tips are engaged with the threaded neck so that the sealing edge is forced into the polymeric material so that polymeric material engages the sealing edges to resist deformation of the neck when forces between the tips and threaded neck are sufficient to seal the closure to the neck.

Alternative exemplary embodiments relate to other features and combinations of features as may be generally recited in the claims. Additionally, the dimensions used in the claims are approximate in that they are dimensions which would be expected from metal closures stamped from metal in a die designed to give a particular dimension. However, variables in processing, material quality, material consistency, etc. will cause expected variations in dimensions. Accordingly, it is the intent of the inventors that the dimensions recited in the claims cover a commensurate range beyond the specific numbers recited.

BRIEF DESCRIPTION OF THE DRAWINGS

This application will become more fully understood from the following detailed description, taken in conjunction with the accompanying figures, wherein like reference numerals refer to like elements in which:

FIGS. 1-5 are to scale. Accordingly, it is the intent of the inventors that the drawings be useable to determine angles, relative dimensions, relative radii, and ratios and percentages based upon the angles, relative dimensions and relative radii relating to the embodiment of the closure and associated container neck.

DETAILED DESCRIPTION OF VARIOUS EMBODIMENTS

Before turning to the figures, which illustrate the exemplary embodiments in detail, it should be understood that the present application is not limited to all of the details or methodology set forth in the description or illustrated in the figures. It should also be understood that the terminology is for the purpose of description only and should not be regarded as limiting.

Figure 1:
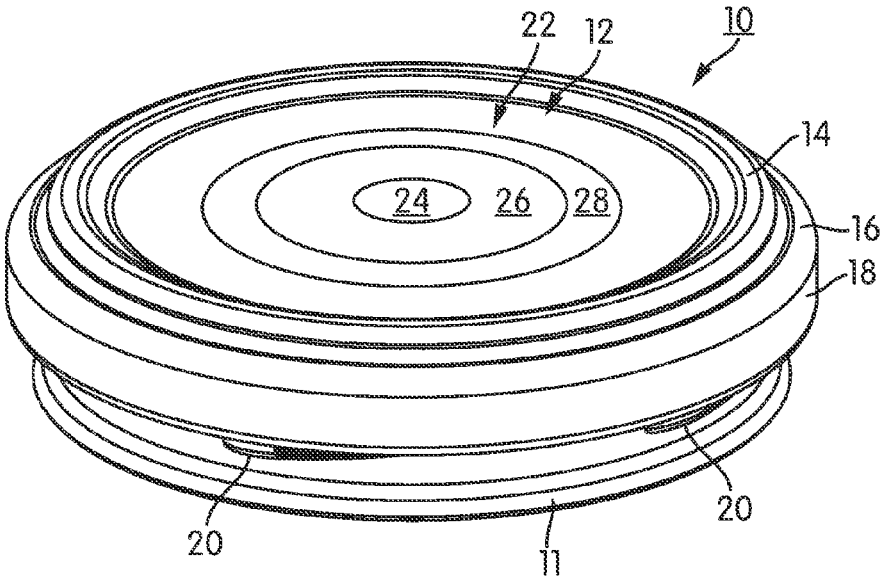
FIG. 1 is a perspective view of an embodiment of a metal closure.
Figure 2:
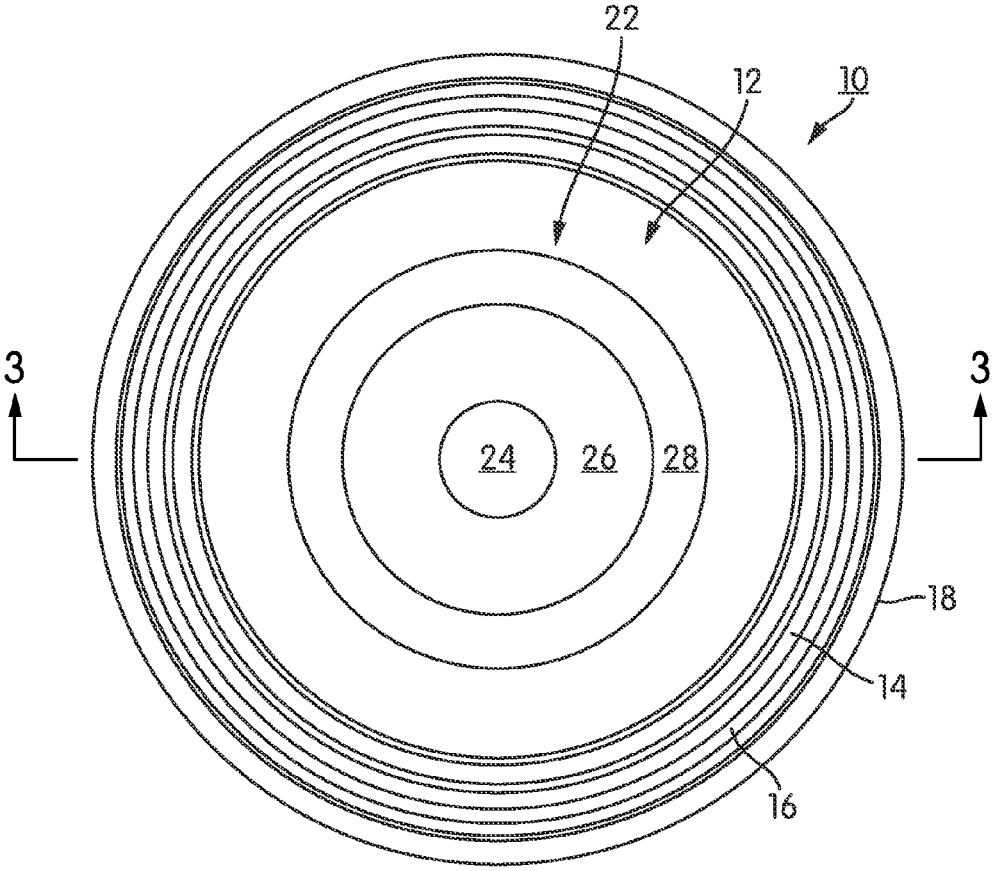
FIG. 2 is a top view of the closure of FIG. 1 engaged with the neck of a plastic container.
Figure 3:
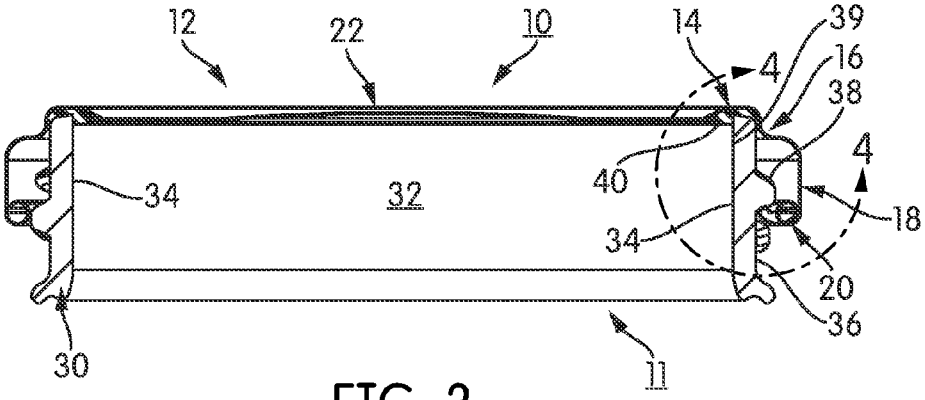
FIG. 3 is a sectional view of the closure engaged with the neck of a plastic container taken along section line 3-3 in FIG. 2.

Referring to FIGS. 1-3, a metal closure 10 includes a circular closure panel 12 joined at its periphery is a concentric channel 14 which is joined to a concentric flange 16. Flange 16 is joined to a cylindrical skirt 18 which supports five (5) thread engagement flanges/lugs 20. The circular closure panel 12 includes a centrally located vacuum-indicating panel 22 which includes a circular center portion 24, a first annular portion 26, and a second annular portion 28. Panel 22 is configured to permit the circular center portion 24 to move relative to the closure panel 12 in response to pressure variations within an associated container 11. To simplify the drawings, only the threaded neck 30 of container 11 is shown. However, any container shape or material having a threaded neck 30 will work with the closure 10 of the present invention where there is a need or perceived need to for a closure which simultaneously seals and resists distortion of the threaded neck 30 as discussed further below.

Figure 4:
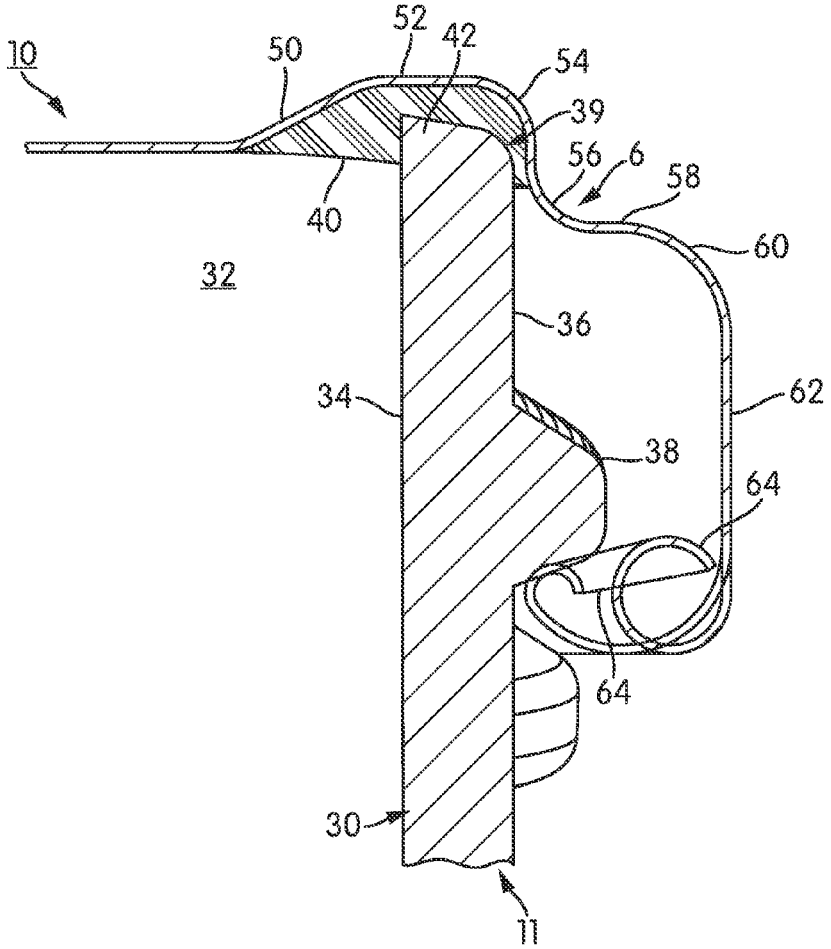
FIG. 4 is an enlarged view of the seal interface between the closure and the neck taken from FIG. 4, using line 4-4 in FIG. 4 as a boundary.
Figure 5:
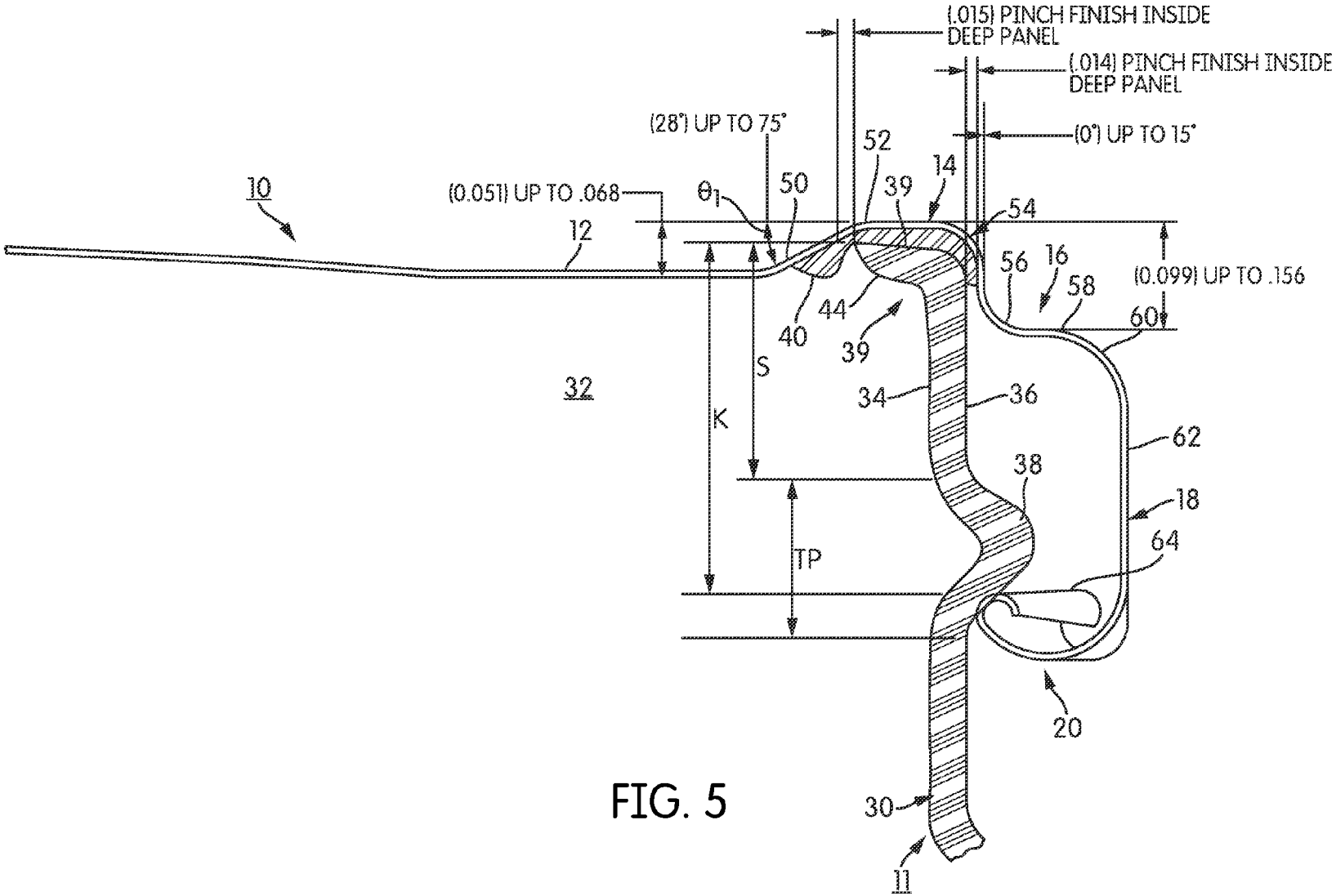
FIG. 5 is a version of the closure of FIG. 4 which is engaged with a neck having a different configuration than the neck of FIG. 4 and includes the dimensions for an embodiment of the closure.

Referring to FIGS. 3-5, the plastic container 11 (e.g., PET, post-consumer-recycled PET, multi-layer, polymer container, etc.) includes the circular threaded neck 30. Neck 30 provides a circular opening 32 to the container 11. The neck 30 includes an internal wall 34, and external wall 36 including a thread 38. The walls 34, 36 terminate at a sealing edge 39. This edge 39 may take any form suitable to deflect and engage a polymeric material 40 in channel 14. FIGS. 4 and 5 illustrate two (2) preferred sealing edge 39 configurations. The configuration of FIG. 4 includes an angled tip 42 for engaging and/or gripping material 40 when closure 10 is sealed to container 11. The configuration of FIG. 5 includes a hook formation 44 which engages and/or grips material 40 when closure 10 is sealed to container 11. When the thread engagement flanges 20 apply force to thread 38 of neck 30, this force has an inward, radial component which will tend to deflect or distort neck 30 from its desired, original, unsealed circular shape. However, closure 10 is configured so that prior to the increase in the radial force component above a level which would distort neck 30, edge 39 engages material 40 so that concentric channel 14 provides radial support to neck 30. This radial support prevents distortion of neck 30 as the radial forces are increased to generate an appropriate seal (e.g. hermetic, air-tight, fluid-tight, etc.) between closure 10 and container 11.

The inventive features of closure 10 are useable with any shape neck of a container. For non-circular containers, the closure 10 thread engagement flanges 20 would be configured so that closure 10 would be pushed (as opposed to turned) onto the container 11. (Note however, that certain circular threaded closures are pushed onto the circular threads of a corresponding container neck even though the end user twists the cap to open the closed container.) In the push-on situation, the thread engagement flanges would be further configured for a particular container so that the component of radial force between the thread engagement flanges and neck reaches is maximum level after the sealing edge is sufficiently engaged with the polymeric material in the channel. Engagement is sufficient when it is able to resist radial deformation of the corresponding neck. As material costs, manufacturing costs, shipping costs, disposal costs and other costs resulting from the use of materials in containers increase, the need for a closure having the features of closure 10 will increase. Examples of such costs are given above, but there may be other costs incurred during the full life cycle of a closure and container, and this cycle which spans from the time the closure and container are manufactured to the time the closure and container are recycled or disposed.

Further details of an embodiment closure 10 will now be described in reference to FIGS. 4 and 5. Some of these details may be eliminated or modified depending upon factors such as manufacturability, material availability and changes, coatings (PET B&T finish) used on the metal (e.g. coated steel from a roll vs. uncoated steel), container material and use, neck shape, etc. (e.g. circular vs. rectangular, etc.)

The concentric channel 14 is configured so that it contains enough material 40 to permit adequate engagement of edge 39 with the material 40 as discussed above. In one embodiment the channel 14 is formed so that the large cross-sectional width of the material is at least 1.5 to 2.5 times the cross-sectional height of the material 40 as shown in detail in FIGS. 4 and 5. These details may depend upon the type of material 40 used. For example, material 40 may be a plastisol liner, synthetic thermoplastic gasket, or a TPE liner inserted into the channel 14. Alternatively, the liner would be formed directly into channel 14 by placing the material 40 into the channel 14 when in liquid form. Another way to size the channel 14 is in reference to the distance between walls 34, 36 of neck 30 ("neck thickness"). By way of example, cross-sectional height of the material 40 may be within 90 to 110% of the neck thickness, and the width may be in the range of 150% to 250% of the neck thickness.

The concentric channel 14 extends from the periphery of closure panel 12 along an angled wall 50 into a parallel wall 52 generally parallel to the closure panel 12. The parallel wall 52 extends into a rounded wall 54 having a center of radius within the closure 10. The parallel wall 52 is offset from the closure panel 12. An exemplary range for this offset distance is between 0.051 and 0.068 inches.

The concentric flange 16 extends from the rounded wall 54 and transitions into a second rounded wall 56 having a center of radius external to the closure 10. The transition between walls 54 and 56 includes a flat transition wall which may have an angle from 0 to 15 degrees where the top of this transition wall is closer to the periphery than the bottom of this transition wall. The second rounded wall 56 extends into a transition wall 58 which extends into a third rounded wall 60 having a center of radius within the closure 10. The radii of the rounded walls 54 and 56 are preferably smaller than the radius of the rounded wall 60. An angle $\theta_1$ between the angled wall 50 and the parallel wall 52 may be between 20 and 75 degrees but in one embodiment is 28 degrees. The transition wall 58 is generally parallel to the closure panel 12 and the parallel wall 52. A plane passing through the transition wall 58 (plane not shown) is displaced further from the parallel wall 52 than the closure panel 12. An exemplary range for this displacement distance is between 0.099 and 0.156 inches. In preferred embodiments, this displacement distance will typically vary in accordance with the offset distance discussed above in a ratio of about 2 to 1, displacement distance to offset distance. However, depending upon the particular application for the cap, this ratio could range between 1 to 1, to 3 to 1.

Furthermore, the height of the combination of the walls 54, 56, 58 and 60 ("combination height") are typically designed relative to a particular container neck. In particular, this height is roughly equal (plus or minus 20%) to the distance from the top of thread 38 to edges 39. As such, referring to FIG. 5, the distance from the bottom of thread 38 (K) minus the thread profile height (TP) equals the combination height (approximately S).

The cylindrical skirt 18 extends from the concentric flange 16, and supports the thread engagement flanges 20 at the bottom thereof (e.g. 4-10 thread engagement flanges depending upon the neck configuration). The thread engagement flanges 20 are preferably equally spaced around the skirt 18, and are separated by rolled flanges 62. The combination of rolled flanges 62 and thread engagement flanges 20 provides a generally smooth bottom surface for closure 10. The thread engagement flanges 20 include a tapered, rolled tip 64, such as that shown in the figures, which facilitates sliding of the engagement of thread engagement flanges 20 relative to a thread 38 on a respective container neck 30.

Referring to FIG. 5, this figure includes the dimensions (in inches), and angles (in degrees) for a preferred embodiment of the closure 10 in the area of the multi-seal sealing structure. These dimensions, angles and radii are exemplary and would be modified within appropriate ranges to accommodate variations such closure size, manufacturing process, mold characteristics, closure material, etc.

While not shown in the figures, it may be desirable to apply a coating to all or a portion (e.g. skirt 18) of closure 10 which improves gripping when closure 10 is metal or another smooth material. Coating the gripping surface of a metal cap/closure with soft-touch polymer can improve the haptics of the gripping surface. The improved gripping surface allows energy to be applied to the rotation and translation with a reduction of force needed for gripping the closure. Suppliers of the soft touch polyurethane coating system are: Alsa Corporation, Sun Chemicals, Valspar and Bayer. Examples of polymer used are polyurethane dispersions, polyester polyurethane dispersions, polycarbonate polyesters, HDI isocyanurates, HDI biuretes, and HDI polyisocyanat. Soft touch coatings may be applied by spraying or applying a film having a soft touch surface thereon.

In various embodiments, the closures discussed herein may be of various sizes intended to seal containers of various sizes and having various contents. In some exemplary embodiments, the closures are configured to seal containers such as metal, glass or plastic containers or bottles for holding liquids, granular materials, food, etc.

Further modifications and alternative embodiments of various aspects of the invention will be apparent to those skilled in the art in view of this description. Accordingly, this description is to be construed as illustrative only. The construction and arrangements of the closure, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A metal closure comprising:

a circular, closure panel having an internal surface extending to a periphery;

a concentric channel extending from the periphery along an angled wall into a parallel wall generally parallel to the closure panel, the parallel wall extending into a first rounded wall having a center of radius within the closure, wherein the parallel wall is offset from the closure panel by a first distance;

a concentric flange extending from the first rounded wall into a second rounded wall having a center of radius external to the closure into a transition wall which extends into a third rounded wall having a center of radius within the closure, wherein the transition wall is generally parallel with the closure panel and the parallel wall, and a plane passing through the transition wall is displaced further from the parallel wall than from the closure panel, wherein the first rounded wall transitions into the second rounded wall at a second distance from the periphery, the second distance being at least 2 times as large as the first distance;

a cylindrical skirt extending from the third rounded wall; and a resilient polymeric material located in the concentric channel.

2. The closure of claim 1, wherein the radii of the first and second rounded walls are smaller than the radius of the third rounded wall.

3. The closure of claim 2, wherein a first angle between the angled wall and a plane defined by the parallel wall is between 20 and 75 degrees.

4. The closure of claim 3, wherein the closure panel has a centrally located vacuum indicating panel which includes a circular center portion, a first annular portion, and a second annular portion configured to permit the circular center portion to move relative to the closure panel in response to pressure variations within an associated container.

5. The closure of claim 4, wherein a flat transition wall extends between the first rounded wall and the second rounded wall, wherein the flat transition wall extends from the first rounded wall at a second angle such that the flat transition wall extends radially away from the periphery.

6. The closure of claim 5, wherein the polymeric material within the concentric channel has a cross-sectional width and a cross-sectional height, wherein the cross-sectional width is greater than the cross-sectional height.

7. The closure of claim 6, wherein the cross-sectional width of the polymeric material is 1.5 to 2.5 times greater than the cross-sectional height.

8. The closure of claim 7, wherein the polymeric material is a plastisol liner.

9. The closure of claim 1, wherein the closure has an exterior surface, wherein at least a portion of the exterior surface thereof is coated with a soft-touch coating.

10. A metal closure comprising:

a closure panel having an internal surface extending to a periphery, wherein a vacuum indicating panel is located at the center of the closure panel;

a channel surrounding the closure panel and extending from the periphery along an angled wall into a radially extending wall, the radially extending wall extending from the angled wall into a first rounded wall having a center of radius within the closure, wherein the radially extending wall is offset from the closure panel by a first distance;

a flange surrounding the channel and extending from the first rounded wall into a second rounded wall having a center of radius external to the closure into a transition wall which extends into a third rounded wall having a center of radius within the closure, wherein the first rounded wall transitions into the second rounded wall at a second distance from the periphery, the second distance being greater than the first distance, an angle between the angled wall and the radially extending wall is between 20 and 75 degrees;

a skirt extending downward from the third rounded wall; and a resilient polymeric material located in the channel;

wherein the transition wall is generally parallel to the closure panel and the radially extending wall, and a plane passing through the transition wall is displaced from the radially extending wall by a third distance.

11. The closure of claim 10, wherein the vacuum indicating panel includes a circular center portion, a first annular portion, and a second annular portion configured to permit the circular center portion to move relative to the closure panel in response to pressure variations within an associated container.

12. The closure of claim 10, wherein the radii of the first and second rounded walls are smaller than the radius of the third rounded wall.

13. The closure of claim 10, wherein the ratio between the third distance and the first distance is 1:1 to 3:1.

14. The closure of claim 10, wherein the polymeric material within the channel has a cross-sectional width and a cross-sectional height, wherein the cross-sectional width is greater than the cross-sectional height.

15. The closure of claim 10, wherein the polymeric material is a plastisol liner.

16. The closure of claim 10, wherein when the closure is fabricated, the resilient polymeric material is in liquid form.

17. A sealed container comprising:

a plastic container including a threaded neck which provides an opening to the container, the neck including internal and external surfaces having a neck thickness that is the distance between the internal and external surfaces, wherein the internal and external surfaces terminate at a sealing edge; and a metal closure including:

a closure panel having an internal surface extending to a periphery, wherein a vacuum indicating panel is located at the center of the closure panel, a channel surrounding the closure panel and extending from the periphery along an angled wall into a radially extending wall, the radially extending wall extending from the angled wall into a first rounded wall having a center of radius within the closure, wherein the radially extending wall is offset from the closure panel by a first distance, a flange surrounding the channel and extending from the first rounded wall into a second rounded wall having a center of radius external to the closure into a transition wall which extends into a third rounded wall having a center of radius within the closure, wherein the transition wall is generally parallel to the closure panel and the radially extending wall, and a plane passing through the transition wall is displaced further from the radially extending wall than from the closure panel, wherein the first rounded wall transitions into the second rounded wall at a second distance from the periphery, the second distance being greater than the first distance, a skirt extending downward from the third rounded wall, and a resilient polymeric material located in the channel having a cross-sectional height and a cross-sectional width;

wherein the sealing edge is forced into the polymeric material so that the polymeric material engages the sealing edge.

18. The container of claim 17, wherein the polymeric material is deformed to move between the external surface and the first rounded wall, and wherein the polymeric material is deformed to move between the internal surface and the angled wall.

19. The container of claim 18, wherein the radii of the first and second rounded walls are smaller than the radius of the third rounded wall.

20. The closure of claim 19, wherein a first angle between the angled wall and a plane defined by the radially extending wall is between 20 and 75 degrees.

21. The container of claim 20, wherein the cross-sectional height of the polymeric material is between 90%-110% of the neck thickness of the container, wherein the cross-sectional width of the polymeric material is between 150%-250% of the neck thickness of the container.

22. The container of claim 21, wherein the threaded neck has a bottom thread distance that extends from the sealing edge to a bottom portion of the threaded neck, and a thread profile height that extends from a top portion of the threaded neck to the bottom portion of the threaded neck.

23. The container of claim 22, wherein the first rounded wall, the second rounded wall, the transition wall and the third rounded wall form a combination height, wherein the combination height is equal to the bottom thread distance minus the thread profile height.

24. The container of claim 23, wherein the polymeric material engages the sealing edge to resist deformation of the threaded neck when forces between the skirt and the threaded neck are sufficient to seal the closure to the threaded neck.

* * * * *